US010651585B2

(12) United States Patent
Chen et al.

(10) Patent No.: US 10,651,585 B2
(45) Date of Patent: May 12, 2020

(54) ELECTRICAL CONNECTOR WITH CONTACT MODULE ASSEMBLED THERETO BY TWO STEPS

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: De-Jin Chen, ShenZhen (CN); Xing-Liang Liu, Shenzhen (CN)

(73) Assignees: FU DING PRECISION COMPONENT (SHEN ZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/391,248

(22) Filed: Apr. 22, 2019

(65) Prior Publication Data

US 2019/0326699 A1 Oct. 24, 2019

(30) Foreign Application Priority Data

Apr. 21, 2018 (CN) ..... 2018 1 0363120

(51) Int. Cl.
*H01R 13/405* (2006.01)
*H01R 13/436* (2006.01)
*H01R 13/24* (2006.01)

(52) U.S. Cl.
CPC ..... *H01R 13/405* (2013.01); *H01R 13/24* (2013.01); *H01R 13/4367* (2013.01)

(58) Field of Classification Search
CPC ..... H01R 9/096; H01R 12/52; H01R 23/722; H01R 13/6315; H01R 13/405; H01R 13/4367; H01R 13/24
USPC ..... 439/65, 247, 248
See application file for complete search history.

(56) References Cited

U.S. PATENT DOCUMENTS 5,479,320 A * 12/1995 Estes ..... H01R 12/52 361/744
5,873,742 A * 2/1999 McHugh ..... H01R 12/716 439/247
6,022,224 A * 2/2000 Peters ..... G11B 33/08 439/66
6,116,957 A * 9/2000 Mickievicz ..... H01R 12/721 439/631
6,155,858 A * 12/2000 Ozawa ..... H01R 13/14 439/248

(Continued)

FOREIGN PATENT DOCUMENTS

CN 105207032 B 3/2018

*Primary Examiner* — Gary F Paumen
(74) *Attorney, Agent, or Firm* — Wei Te Chung; Ming Chieh Chang

(57) ABSTRACT

An electrical connector includes an insulative housing and a contact module essentially composed of a plurality of contacts integrally formed within an insulator via an insert-molding process wherein the contact module is assembled to the housing via two steps along different directions perpendicular to each other. The housing forms a plurality of protrusions engaged with the corresponding ribs of contact module in the vertical direction so as to retain the contact module to the housing reliably. All the insulator, the contacts and the housing are arranged in a staggered manner.

20 Claims, 13 Drawing Sheets

(56) References Cited

U.S. PATENT DOCUMENTS

| | | | | |
|---|---|---|---|---|
| 6,347,950 | B1 * | 2/2002 | Yokoyama | H01R 13/6315 439/248 |
| 7,635,274 | B2 * | 12/2009 | Fukazawa | H01R 12/716 439/247 |
| 9,033,722 | B2 * | 5/2015 | Kobayashi | H01R 12/712 439/248 |
| 2007/0087607 | A1 * | 4/2007 | Nagano | H01R 13/506 439/288 |
| 2007/0202729 | A1 * | 8/2007 | Uesaka | H01R 12/57 439/248 |
| 2007/0218764 | A1 * | 9/2007 | Chang | H01R 13/2435 439/607.01 |
| 2008/0293262 | A1 * | 11/2008 | Duesterhoeft | H01R 12/78 439/65 |
| 2011/0294326 | A1 * | 12/2011 | Tanaka | H01R 12/712 439/248 |

* cited by examiner

200

ELECTRICAL CONNECTOR WITH CONTACT MODULE ASSEMBLED THERETO BY TWO STEPS

BACKGROUND OF THE INVENTION

1. Field of the Invention

The present invention relates generally to an electrical connector, and more particularly to an electrical connector with the contact module assembled thereto with two steps along different directions perpendicular to each other.

2. Description of Related Arts

China Patent No. CN 105207032 issued on Mar. 2, 2018, disclosed an electrical connector connecting two neighboring printed circuit boards located at the same level. The electrical connector includes an insulative housing retaining a plurality of resilient contacts via a discrete securing block wherein each contacts has opposite resilient contacting sections respectively electrically and mechanically connecting to the corresponding conductive pads on the printed circuit boards. Notably, the respective contacts is secured to the housing at the middle section via the securing block so as to result in potentially an unstable retention disadvantageously.

An improved electrical connector is desired.

SUMMARY OF THE INVENTION

An object of the present invention is to provide an electrical connector with an insulative housing and a contact module essentially composed of a plurality of contacts integrally formed within an insulator via an insert-molding process wherein the contact module is assembled to the housing via two steps along different directions perpendicular to each other. The housing forms a plurality of protrusions engaged with the corresponding ribs of contact module in the vertical direction so as to retain the contact module to the housing reliably. All the insulator, the contacts and the housing are arranged in a staggered manner

DETAILED DESCRIPTION OF THE PREFERRED EMBODIMENT

Figure 1:
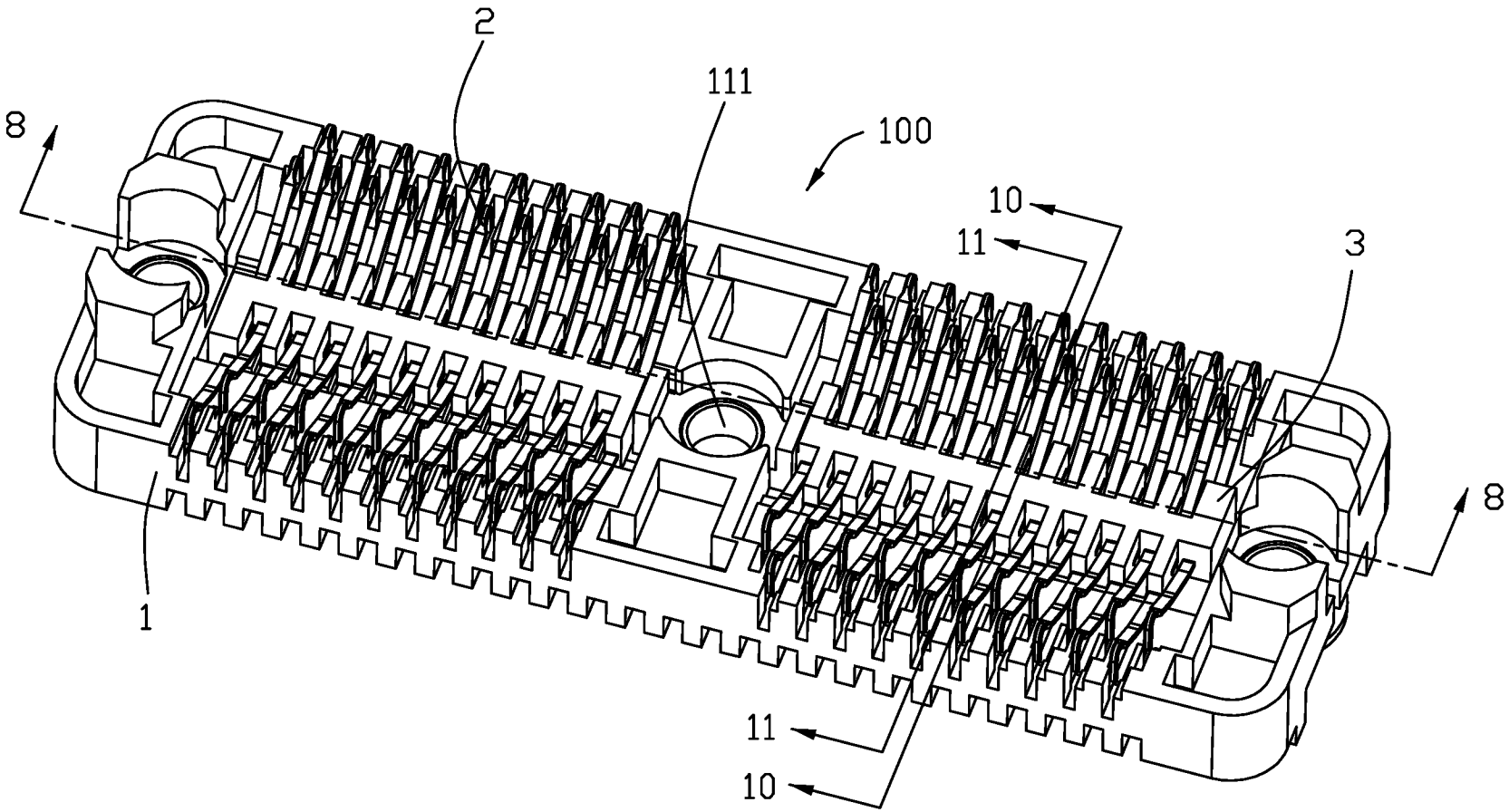
FIG. 1 is a perspective view of an electrical connector in accordance with the present invention.
Figure 2:
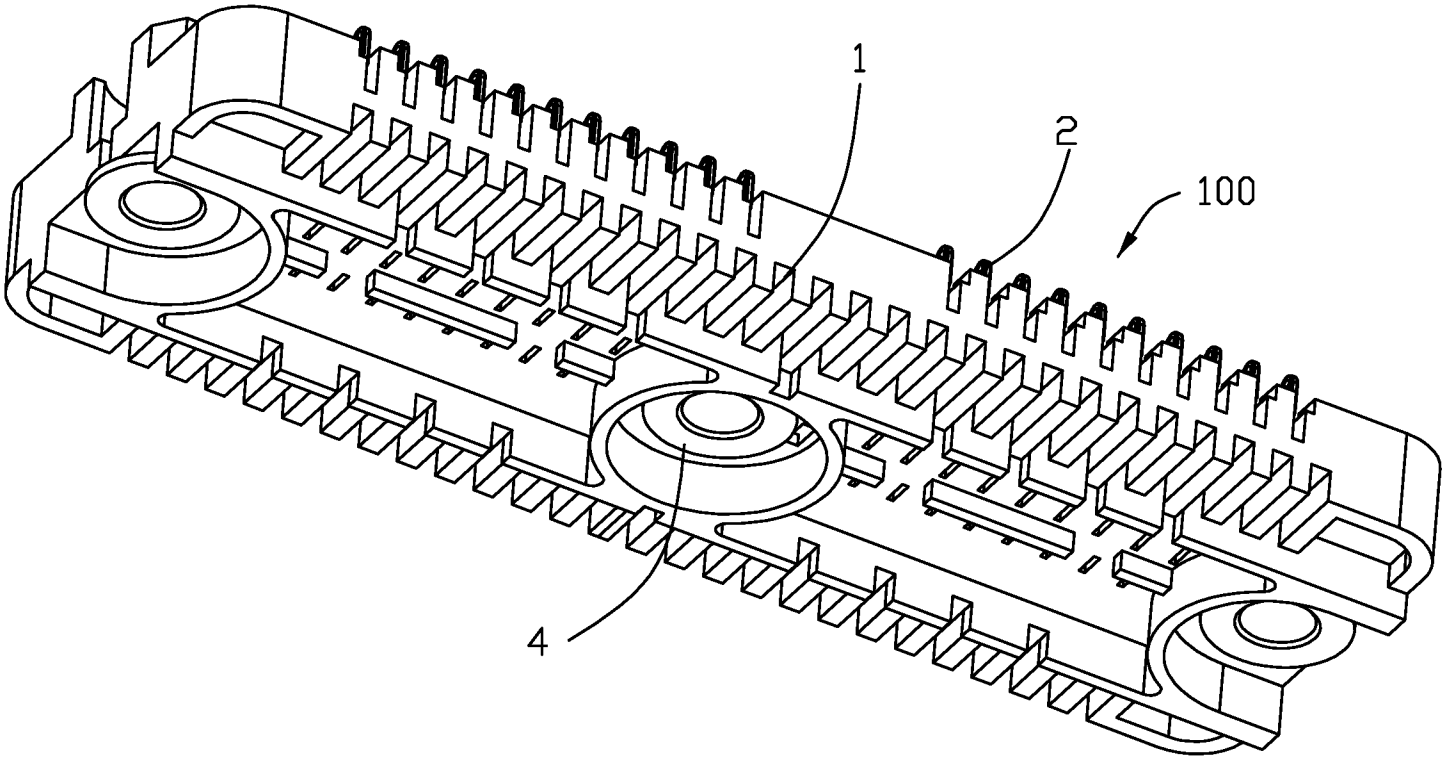
FIG. 2 is another perspective view of the electrical connector of FIG. 1.
Figure 3:
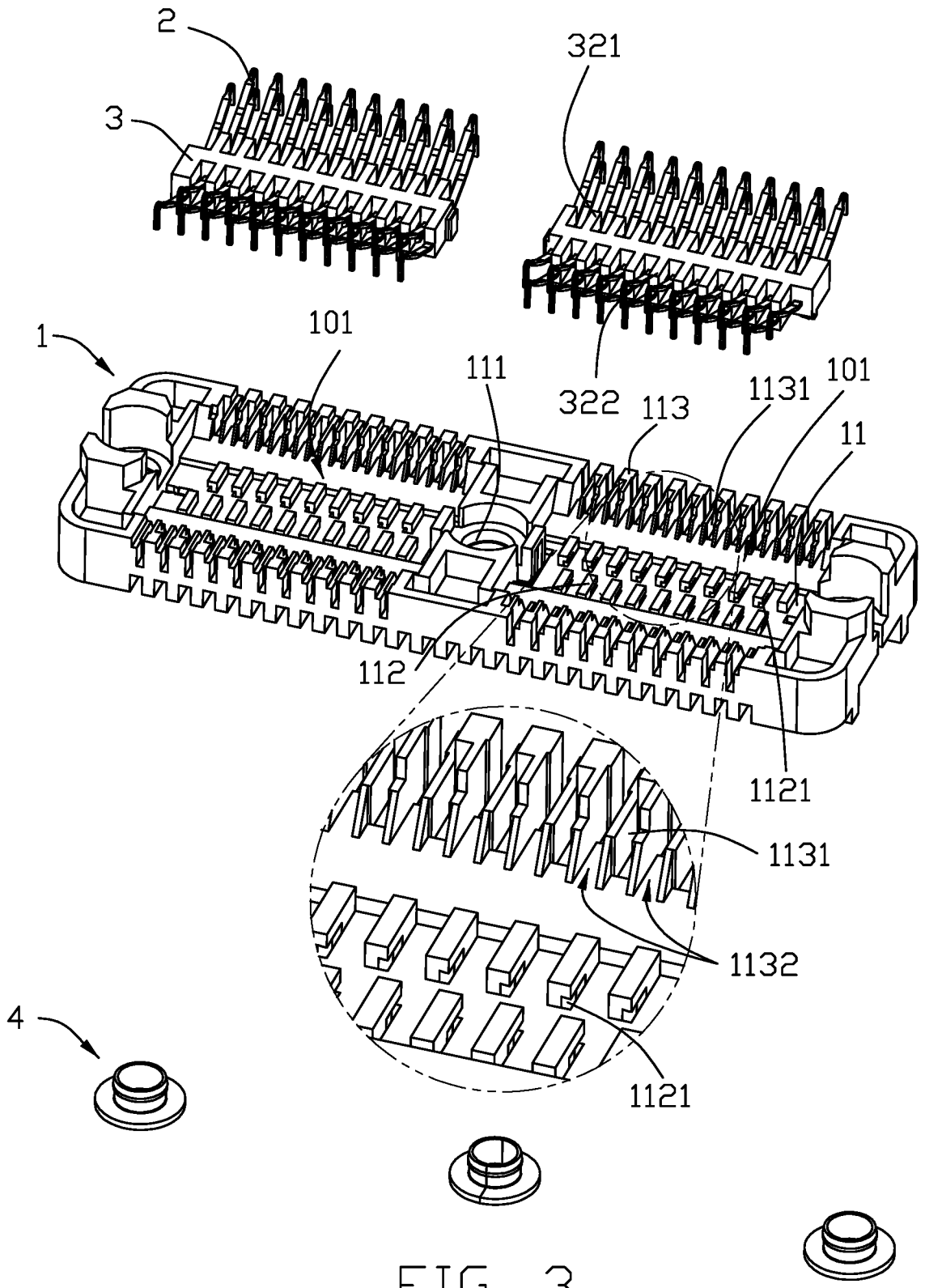
FIG. 3 is an exploded perspective view of the electrical connector of FIG. 1.
Figure 4:
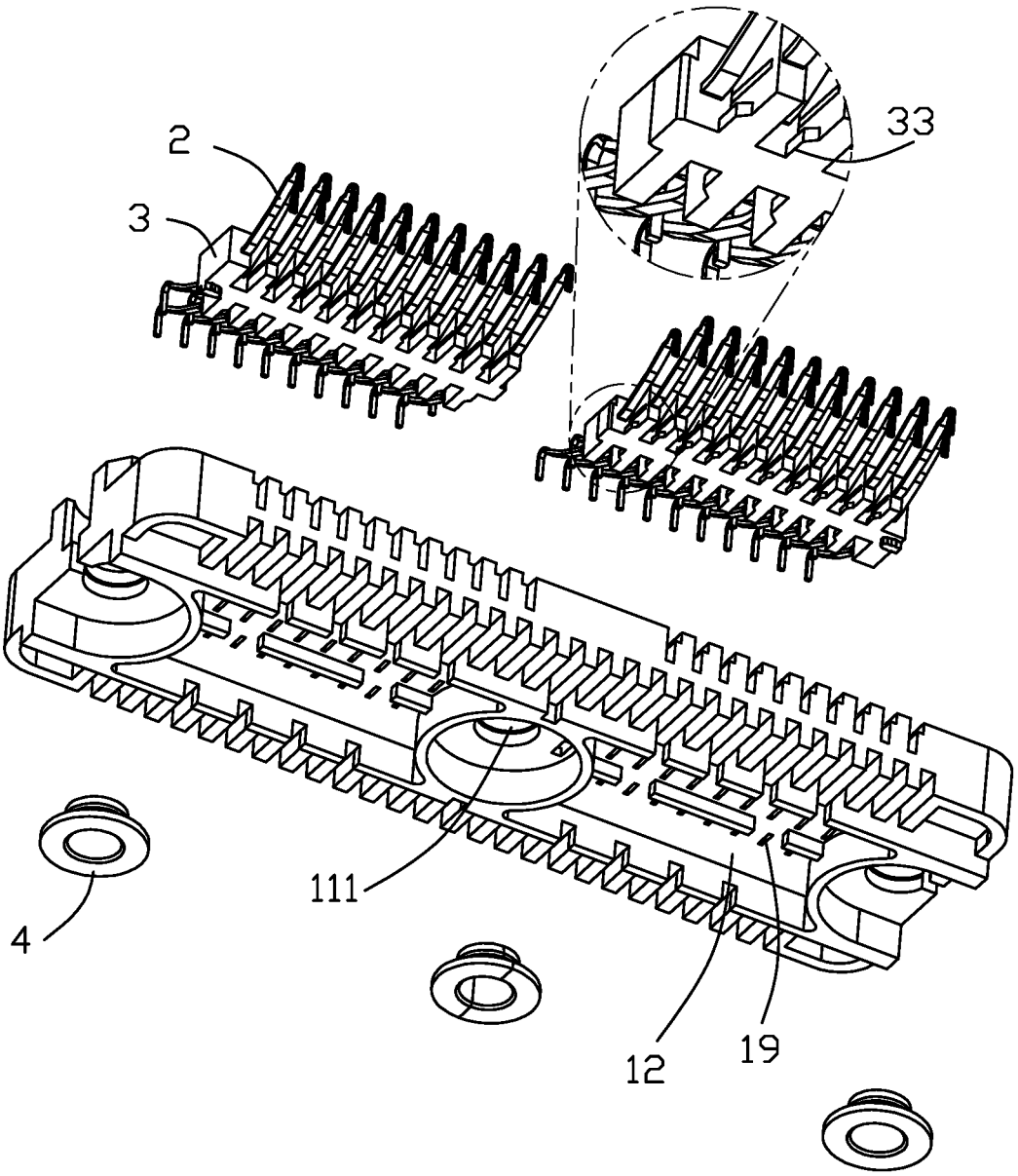
FIG. 4 is another exploded perspective view of the electrical connector of FIG. 3.
Figure 5:
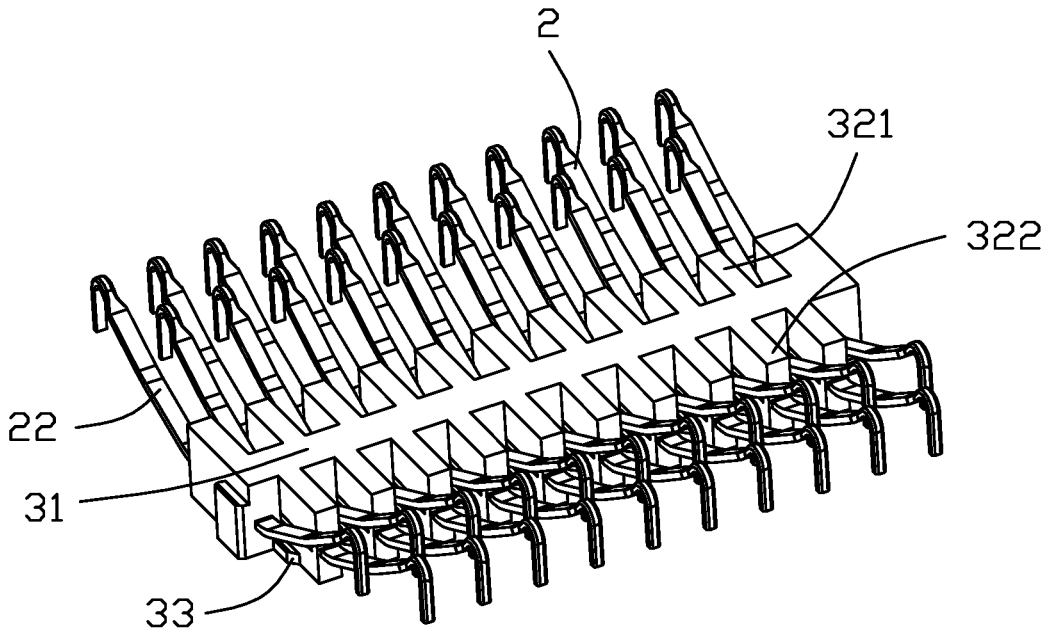
FIG. 5 is a perspective view of the contact module of the electrical connector of FIG. 3.
Figure 6:
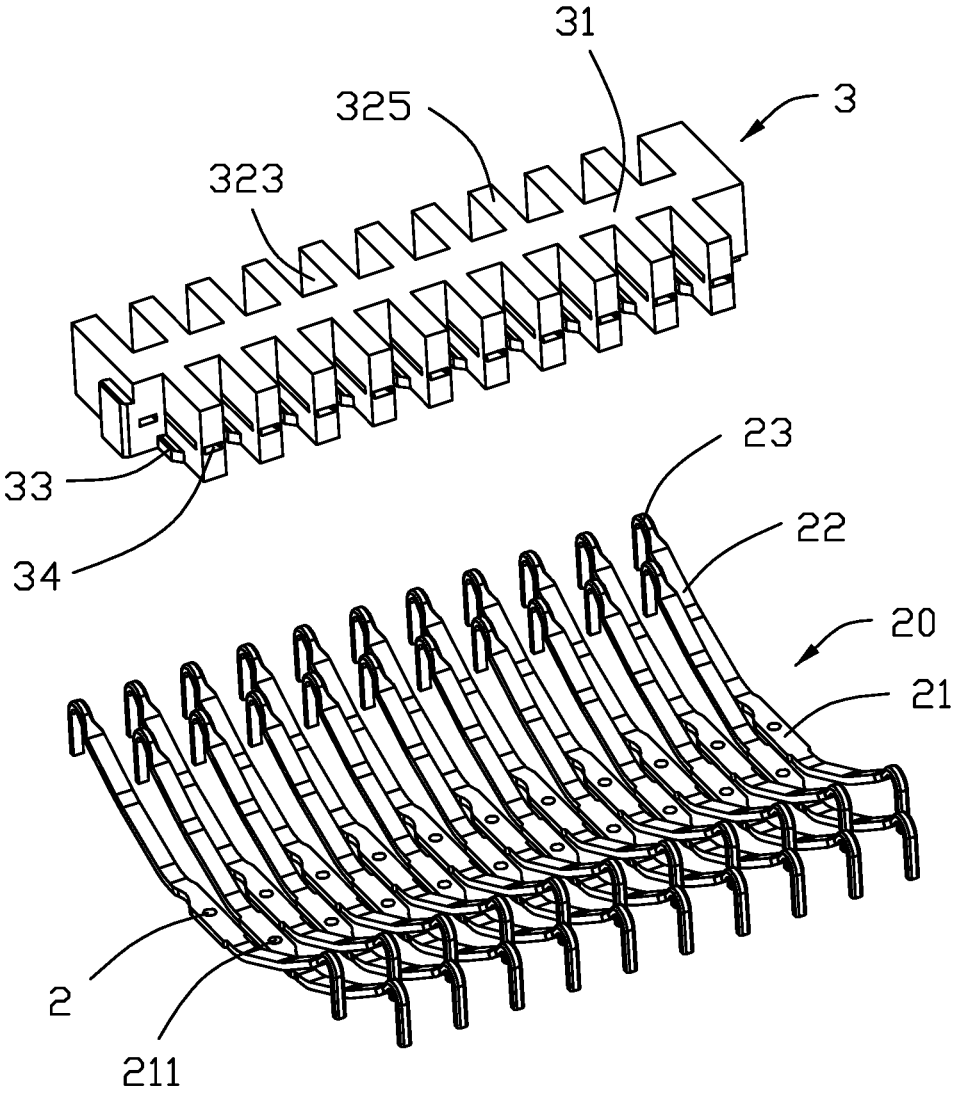
FIG. 6 is an exploded perspective view of the contact module of the electrical connector of FIG. 5.
Figure 7:
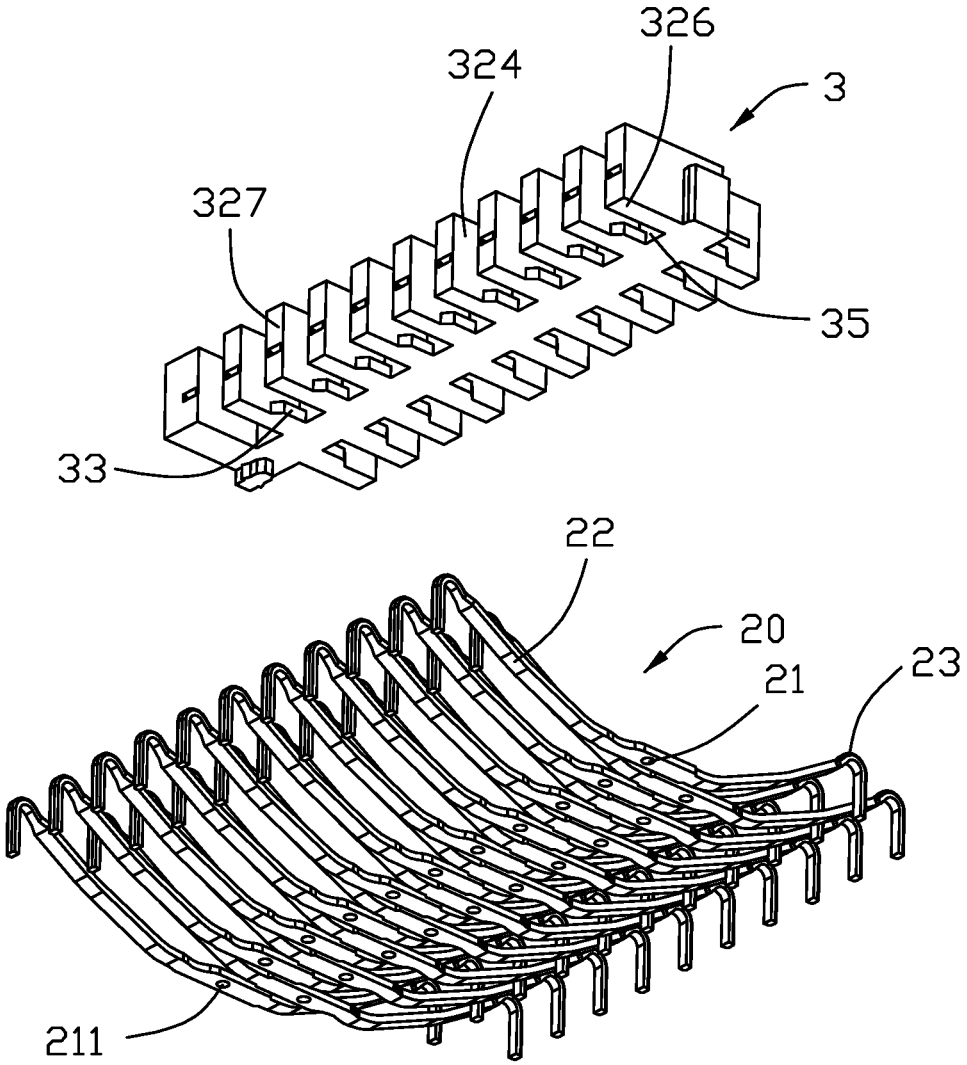
FIG. 7 is another exploded perspective view of the contact module of the electrical connector of FIG. 5.

Referring to FIG. 1-11, an electrical connector 100 for mating with a pair of side by side arranged printed circuit boards (not shown), includes an insulative housing 1, two contact modules 200 secured to the housing 1 and each contact module 200 including a plurality of contacts 2 integrally formed with an insulator 3 via an insert-molding process, and a plurality of securing nuts 4 for mounting the connector 100 to the corresponding electronic part (not shown).

The housing 1 is of an elongated structure and includes an upward surface 11 and a downward surface 12 opposite to each other in the vertical direction. Three securing holes 111 are formed to receive the corresponding securing nuts 4. A pair of receiving cavities 101 are formed among the holes 111 and above the upward surface 11 to receive the corresponding contact modules 200, respectively. Two rows of protrusions 112 are formed upon the upward surface 11 around a center region, and two rows of dividers 113 upwardly extend from the upward surface 11 along two opposite elongated side regions. The two rows of protrusion 112 are offset from each other so as to form a staggered manner along the longitudinal direction. The dividers 113 are higher than the protrusions 112 in the vertical direction perpendicular to the longitudinal direction, and respectively aligned with the neighboring protrusions 112 in the transverse direction perpendicular to the longitudinal direction and the vertical direction. Each protrusion 112 forms an engagement recess 1121 which downward faces to the upward surface 11 and horizontally faces to the neighboring protrusion 112 along the longitudinal direction. The divider 113 forms a passageway 1131 to receive a free tip of the corresponding contact 2 (illustrated later).

The contacts 2 are arranged along the longitudinal direction in a stagger manner, i.e., being offset along the transverse direction. Each contact 2 extending along the transverse direction, includes a center retaining section 21, and a pair of spring arms 22 extending therefrom opposite to each other along the transverse direction with corresponding contacting sections 23 at free end regions, respectively. In this embodiment, the heights of the contacting section 23 are essentially at the same level. Each contacting section 23 forms an upside-down U-shape or C shape. The retaining section 21 forms at least a retention hole 211 for receiving material of the insulator 3 so as to prevent relative movement with regard to the insulator 3 along the transverse direction.

Figure 10:
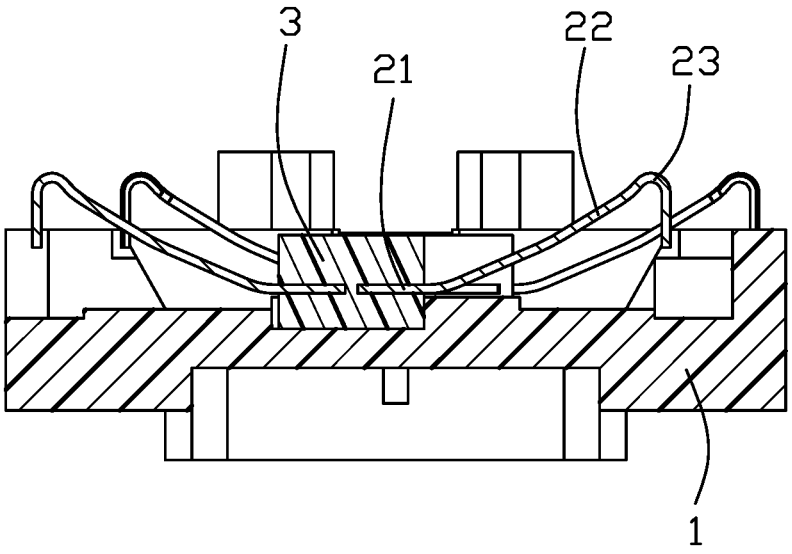
FIG. 10 is a cross-sectional view of the electrical connector of FIG. 1 along line 10-10 to show how the contacting sections of the contact module positioned with regard to the housing.
Figure 11:
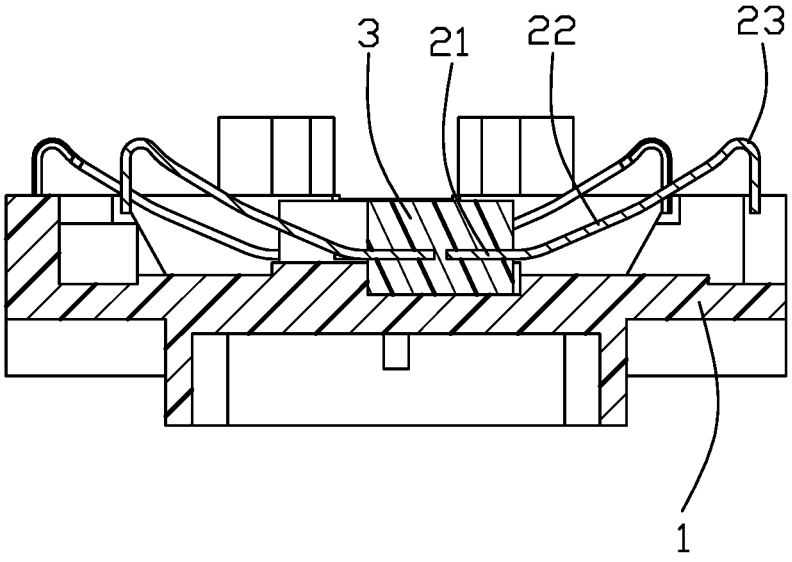
FIG. 11 is another cross-sectional view of the electrical connector of FIG. 1 along line 11-11 to show how the contacting sections of the contact module positioned with regard to the housing.

The insulator 3 includes a main body 31 extending along the longitudinal direction, and first row 321 and second row 322 of partitions 32 by two sides of the main body 31. Each partition 32 extends along the transverse direction. The first row 321 of partitions 32 and the second row 322 of partition 32 are offset from each other along the longitudinal direction so that both first row 321 and second row 322 of partitions 32 are arranged in a stagger manner. Notably, when assembled, each partition 32 is located between the two corresponding adjacent protrusions 112 along the longitudinal direction. Each partition 32 forms opposite side faces 323, 324 and opposite upper face 325 and lower face 326, and a front face 327. Each partition 32 further includes a rib 33 on the side face 324, and a receiving hole 34 receiving the retention section 21 of the corresponding contact 2. A tiny post (not shown) is formed in the receiving hole 34 to be received within the retention hole 211 of the retention section 21. Understandably, such a receiving hole 34 is naturally formed when the contact 2 is insert-molded with the insulator 3. Understandably, because the partitions 32 are arranged in the staggered manner, the contacts 22 are also arranged in the staggered manner as mentioned before. After assembled, the rib 33 is received within the corresponding engagement recess 1121. A receiving space 35 is formed between every adjacent two partitions 32, and the corresponding protrusion 112 is located in the receiving space 35. As shown in FIGS. 10 and 11, for each contact 2, the two spring arms 22 are dimensioned to be equal to each other wherein one spring arm 22 is received in the corresponding receiving space 35 between two partitions and the associated contacting section 23 thereof is received in the passageway 1131 of the corresponding divider 113 while the associated contacting section 23 of the other spring arm 22 is received within a space 1132 between the corresponding pair of dividers 113 in the longitudinal direction. Understandably, the spring arm 22 received in the receiving space 35 should extend over the corresponding protrusion 112 which is located between the corresponding pair of partitions 32.

The electrical connector 100 is made by the following processes in sequence. The contacts 2 are integrally formed with the insulator 3 to form the contact module 200. The contact module 200 is downwardly assembled into the receiving cavity 101 to have the partitions 32 and the protrusions 112 are alternated with each other along the longitudinal direction. The contact module 200 is further moved along the longitudinal direction to have the ribs 33 received within the corresponding engagement recesses 1121. At the same time, in the corresponding contact 2, one contacting section 23, which is originally not precisely aligned with the corresponding passageway 1131, is precisely aligned with the corresponding passageway 1131 so as to be allowed to be downwardly deflected during mating with the corresponding printed circuit board. And, the other contacting section 23 is properly received within space 1132. Lastly, the whole connector 100 is assembled to the electronic part via the securing nuts 4.

Figure 8:
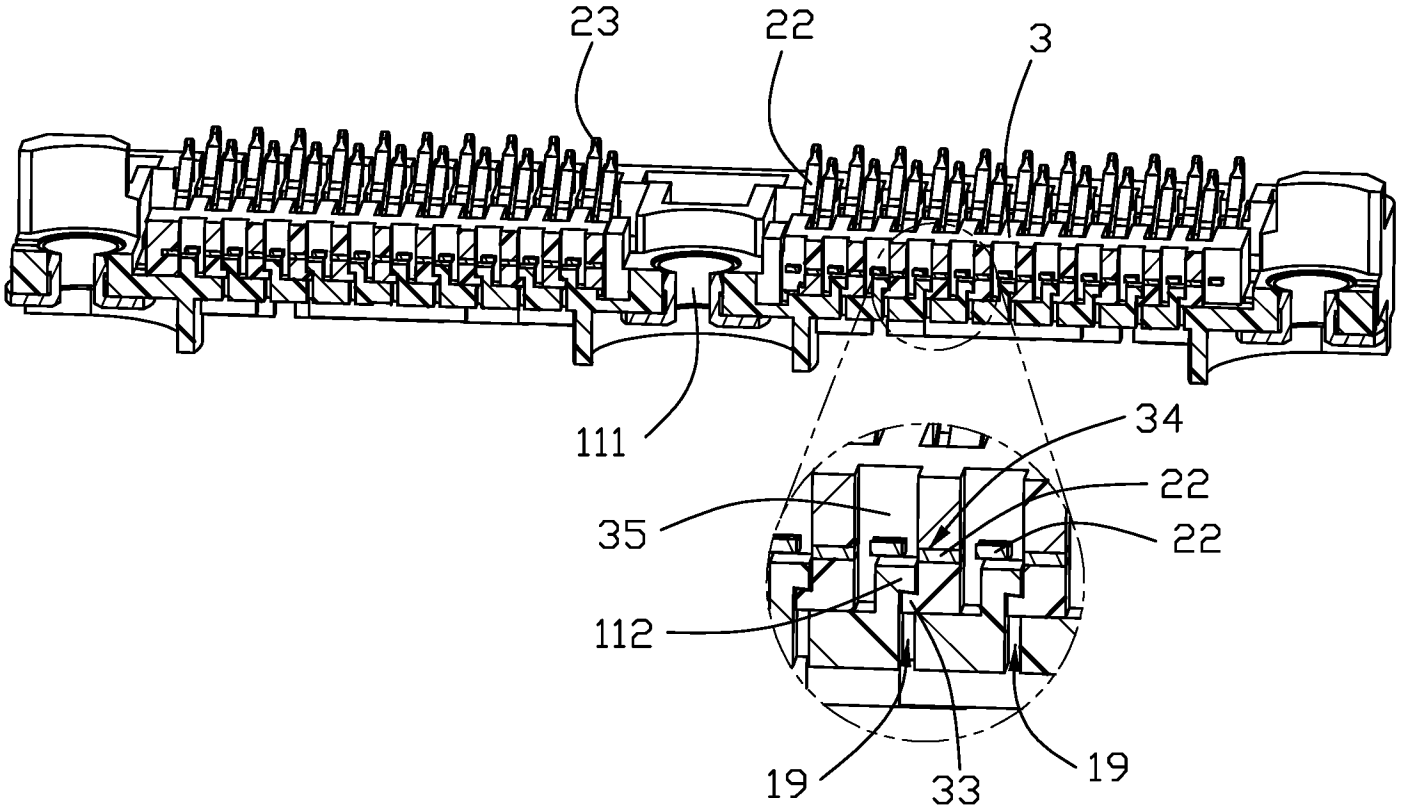
FIG. 8 is a cutaway view of the electrical connector of FIG. 1 along line 8-8 with a cross-section thereof to show how the ribs of the contact module engaged with the corresponding protrusions of the housing in the vertical direction for securing the contact module to the housing.
Figure 8A:
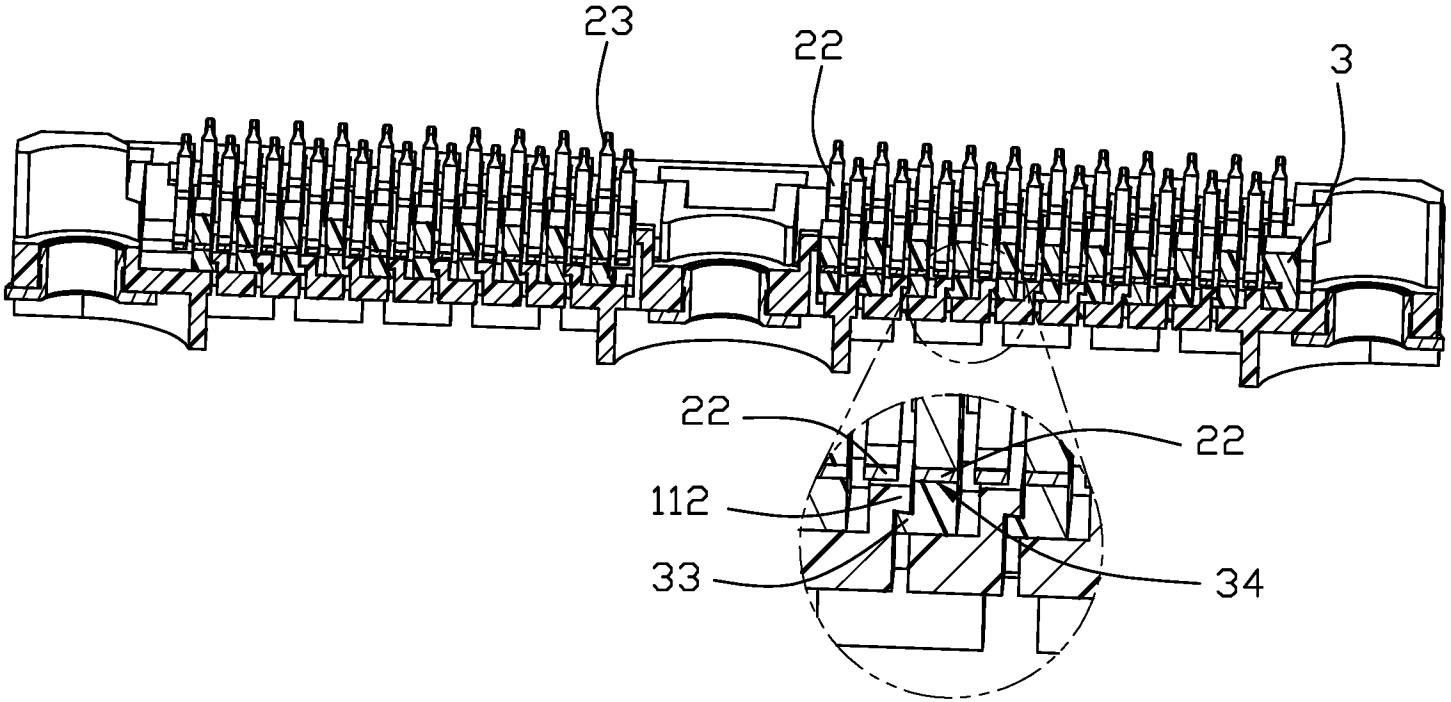
FIG. 8(A) is another cutaway view of the electrical connector of FIG. 1 along line 8A-8A
Figure 9:
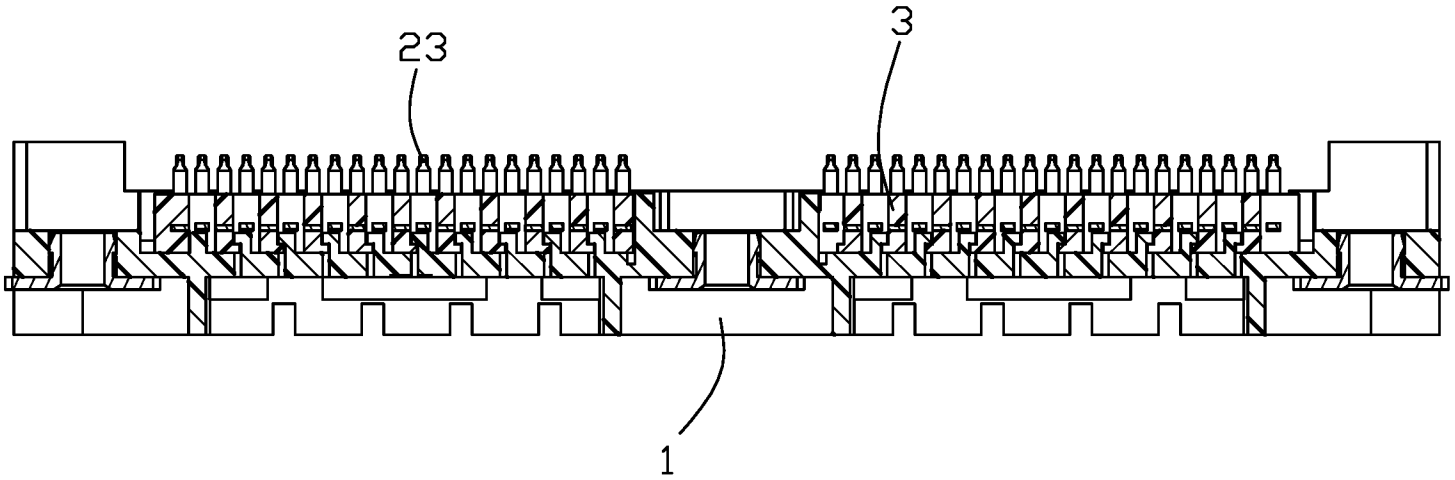
FIG. 9 is a cross-sectional view of the electrical connector of FIG. 8.
Figure 9A:
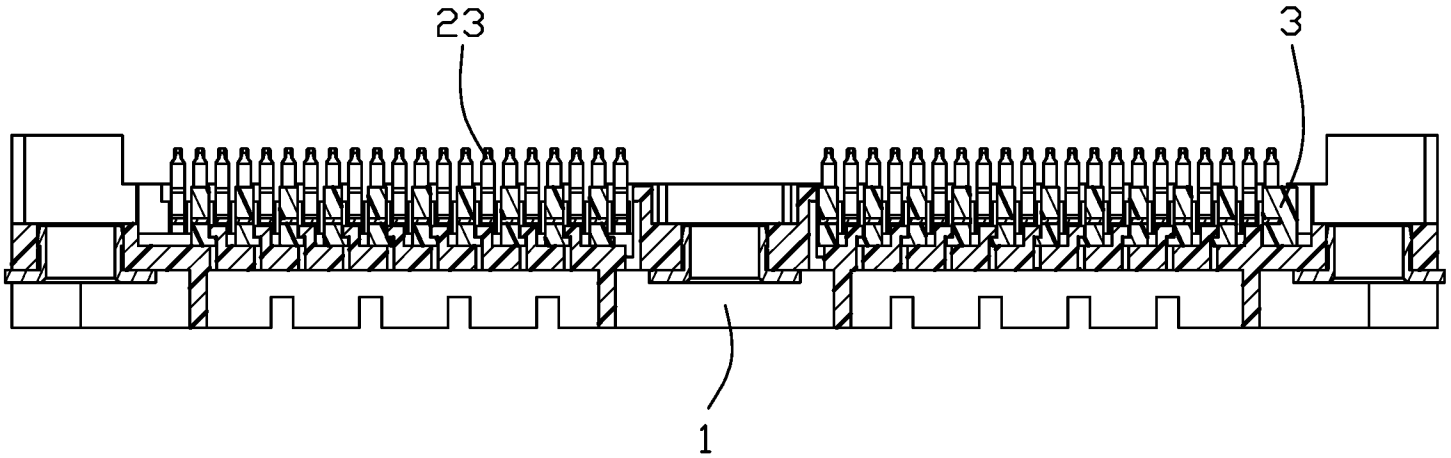
FIG. 9(A) is another cross-sectional view of the electrical connector of FIG. 8(A)

Notably, there may be a minor gap between the housing 1 and the insulator 3 after the contact module 200 is moved to its final position, which may be filled by the stuffer. Alternately, a dimple may be formed on the upward surface 11 of the housing 1 to prevent backward movement of the insulator along the longitudinal direction once the contact module 200 is moved to its final position in the longitudinal direction. Anyhow, in this embodiment, as shown in FIGS. 8 and 8(A), the cantilevered rib 33 and the corresponding engagement recess 1121 are of a reversed wedged structure so as to assure reliable engagement therebetween. In addition, the housing 1 forms a through hole 19 under the engagement recess 1121 so as to have the engagement recess downwardly communicate with an exterior not only for the molding consideration but also for deflection of the rib 33 during assembling. Notably, to allow the horizontal movement of the insulator 3 with regard to the housing 1, the receiving space 35 is larger, in the longitudinal direction, than the protrusion 112 received in the receiving space 35. Also, in this embodiment a width of the partition 32 is smaller than a width of the receiving space 35 in the longitudinal direction. In this embodiment, the width of the rib 33 is limited so as not to have the rib 33 partially overlapped with the spring arm 22 of the corresponding contact 2 in the vertical direction but in an offset manner for molding consideration during insert-molding the contact module 200.

Another feature of the invention is to provide the insulator 3 and the corresponding contacts 2 with a staggered manner for maintaining the uniformed strength along the longitudinal direction. Therefore, the housing 1 is also required to be formed in a staggered manner for comply with the contacting sections 23 of the contacts. A further feature of the invention is to have the engagement between the insulator 3 and the housing 1 around the paired ribs 3 and protrusions 112 evenly arranged along the longitudinal direction with a plurality of engagement points. As well known, most prior arts regarding engagement between the housing and the insulator of the contact module fail to disclose this multiple positions feature but only around a boundary of the insulator disadvantageously.

What is claimed is:

1. An electrical connector comprising:

an insulative housing forming a receiving cavity with an upward surface below the receiving cavity;

a contact module assembled into the receiving cavity, and including a plurality of contacts integrally formed with an insulator, the insulator including a main body extending along a longitudinal direction, and a plurality of partitions located on two sides of the main body, each of said partitions extending along a transverse direction perpendicular to the longitudinal direction, said partitions being arranged in a staggered manner, and the contacts arranged with one another along the longitudinal direction, secured to the corresponding partitions, respectively, and extending along the transverse direction, each contact includes a center retaining section and a pair of spring arms extending from two sides of the retaining section opposite to each other in the transverse direction with corresponding contacting sections, respectively; wherein the housing forms a plurality of dividers along two opposite side edge regions in the longitudinal direction, and each divider forms a passageway therein; wherein in each contact, one corresponding contacting section is received within one corresponding passageway, and the other corresponding contacting section is received in a space between the corresponding two neighboring dividers along the longitudinal direction.

2. The electrical connector as claimed in claim 1, wherein the spring arms are dimensioned to be equal to each other in the transverse direction.

3. The electrical connector as claimed in claim 1, wherein in each contact, one spring arm is located between the corresponding two adjacent partitions in the longitudinal direction, and the corresponding contacting section of said one spring arm is located in the corresponding passageway.

4. The electrical connector as claimed in claim 3, wherein in each contact, the other spring arm is not located between any neighboring partitions in the longitudinal direction, and the corresponding contacting section of said other spring arm is located in the space between the two neighboring dividers.

5. The electrical connector as claimed in claim 1, wherein a plurality of protrusions are formed on an upward surface of the housing, and each protrusion is located between the corresponding two partitions in the longitudinal direction.

6. The electrical connector as claimed in claim 5, wherein each protrusion forms an engagement recess, and each partition forms a rib engaged within the engagement recess in a vertical direction perpendicular to both the longitudinal direction and the transverse direction.

7. The electrical connector as claimed in claim 6, wherein the rib and the engagement recess are of a reversed wedged configuration.

8. The electrical connector as claimed in claim 6, wherein the housing forms a plurality of through holes aligned with and communicatively located under the corresponding engagement recesses, respectively.

9. An electrical connector comprising:

an insulative housing forming a receiving cavity with an upward surface below the receiving cavity;

a contact module assembled into the receiving cavity, and including a plurality of contacts integrally formed with an insulator, the insulator including a main body extending along a longitudinal direction, and a plurality of partitions located on two sides of the main body, each of said partitions extending along a transverse direction perpendicular to the longitudinal direction, said partitions being arranged in a staggered manner, a receiving space defined between every adjacent two partitions; and the contacts arranged with one another along the longitudinal direction, secured to the corresponding partitions, respectively, and extending along the transverse direction, each contact includes a center retaining section and a pair of spring arms extending from two sides of the retaining section opposite to each other in the transverse direction with corresponding contacting sections, respectively; wherein two rows of protrusions are formed on an upward surface of the housing in the staggered manner, and each of said protrusion is located in the corresponding receiving space; wherein the receiving space is larger than the corresponding protrusion in the longitudinal direction so as to allow the insulator to move relative to the housing in the longitudinal direction.

10. The electrical connector as claimed in claim 9, wherein each protrusion forms a downwardly facing engagement recess, and each partition forms a rib engaged within the engagement recess in a vertical direction perpendicular to both the longitudinal direction and the transverse direction.

11. The electrical connector as claimed in claim 10, wherein said housing forms a plurality of through holes aligned with and communicatively located under the corresponding engagement recesses, respectively.

12. The electrical connector as claimed in claim 10, wherein the rib and the engagement recess are of a reversed wedged configuration.

13. The electrical connector as claimed in claim 9, wherein in each contact, one spring arm is located in the receiving space of the two neighboring partitions, and said one spring arm extends above the corresponding protrusion in a vertical direction perpendicular to both the longitudinal direction and the transverse direction.

14. The electrical connector as claimed in claim 9, wherein the rib and the spring arm sharing the same receiving space, are not partially overlapped in the vertical direction but in an offset manner for molding consideration during insert-molding said contact module.

15. The electrical connector as claimed in claim 9, wherein a width of each partition is smaller than a width of the receiving space in the longitudinal direction.

16. An electrical connector comprising:

an insulative housing forming a receiving cavity with an upward surface below the receiving cavity;

a contact module assembled into the receiving cavity, and including a plurality of contacts integrally formed with an insulator, the insulator including a main body extending along a longitudinal direction, and two rows of partitions respectively located on two sides of the main body, each of said partitions extending along a transverse direction perpendicular to the longitudinal direction, a receiving space defined between every adjacent two partitions; and the contacts arranged with one another along the longitudinal direction, secured to the corresponding partitions, respectively, and extending along the transverse direction, each contact includes a center retaining section and a pair of spring arms extending from two sides of the retaining section opposite to each other in the transverse direction with corresponding contacting sections, respectively; wherein two rows of protrusions are formed on an upward surface of the housing corresponding to said two rows of partitions, and each of said protrusion is located in the corresponding receiving space; wherein each protrusion forms a downwardly facing engagement recess, and each partition forms a rib; wherein the receiving space is larger than the corresponding protrusion in the longitudinal direction so as to allow the insulator to move relative to the housing in the longitudinal direction to have the rib engaged within the engagement recess in a vertical direction perpendicular to both the longitudinal direction and the transverse direction.

17. The electrical connector as claimed in claim 16, wherein a width of the partition is smaller than a width of the receiving space in the longitudinal direction.

18. The electrical connector as claimed in claim 16, wherein said housing forms a plurality of through holes aligned with and communicatively located under the corresponding engagement recesses, respectively.

19. The electrical connector as claimed in claim 16, wherein the rib and the engagement recess are of a reversed wedged configuration.

20. The electrical connector as claimed in claim 16, wherein the rib and the spring arm sharing the same receiving space, are not partially overlapped in the vertical direction but in an offset manner for molding consideration during insert-molding said contact module.

* * * * *